US008789325B2

(12) United States Patent
Verhaeghe

(10) Patent No.: US 8,789,325 B2
(45) Date of Patent: Jul. 29, 2014

(54) WALL ASSEMBLY FOR WOODEN STRUCTURES

(75) Inventor: Thomas Daniel Antoon Verhaeghe, Waregem (BE)

(73) Assignee: Verhaeghe Chalets & Sauna NV, Harelbeke (BE)

( * ) Notice: Subject to any disclaimer, the term of this patent is extended or adjusted under 35 U.S.C. 154(b) by 0 days.

(21) Appl. No.: 13/994,336

(22) PCT Filed: Dec. 9, 2011

(86) PCT No.: PCT/IB2011/002979

§ 371 (c)(1),
(2), (4) Date: Jun. 14, 2013

(87) PCT Pub. No.: WO2012/080801

PCT Pub. Date: Jun. 21, 2012

(65) Prior Publication Data

US 2013/0263554 A1 Oct. 10, 2013

(30) Foreign Application Priority Data

Dec. 16, 2010 (BE) ..... 2010/0744

(51) Int. Cl.

| | |
|---|---|
| ***E04B 2/08*** | (2006.01) |
| ***E04B 2/70*** | (2006.01) |
| ***E04H 1/12*** | (2006.01) |

(52) U.S. Cl.

CPC . *E04B 2/08* (2013.01); *E04B 2/705* (2013.01); *E04H 1/125* (2013.01); *E04H 2001/1288* (2013.01)

USPC ..... 52/233; 52/561; 52/582.1; 52/586.2; 52/601; 52/775; 4/524

(58) Field of Classification Search

CPC ..... E04B 2/08; E04B 2/705; E04H 1/125; E04H 2001/1288

USPC ..... 52/233, 582.1, 586.1, 586.2, 775, 281, 52/282.1, 284, 561, 563, 564, 569, 570, 52/571, 572, 601, 604, 762, 770, 771, 52/772; 4/524

See application file for complete search history.

(56) References Cited

U.S. PATENT DOCUMENTS 1,898,297 A * 2/1933 Fox ..... 446/122
2,059,565 A * 11/1936 Driver ..... 52/463

(Continued)

FOREIGN PATENT DOCUMENTS

AU 2010200477 A1 9/2010
DE 19739787 A1 * 4/1999

(Continued)

OTHER PUBLICATIONS

International Search Report for PCT/IB2011/002979 mailed Mar. 22, 2012 (4 pages).*

(Continued)

*Primary Examiner* — Basil Katcheves
*Assistant Examiner* — Rodney Mintz
(74) *Attorney, Agent, or Firm* — Symbus Law Group, LLC; Clifford D. Hyra

(57) ABSTRACT

A wall assembly (1) for the construction of a wall element (14), wherein accumulation of the shrinkage heights of the different beams to form a major shrinkage for every wall element (14) is avoided, having two profiles (3) extending substantially vertically, two beams (2), stacked one on top of the other and extending substantially horizontally between the two profiles (3) and that have at each end a positioning end (6) that has a smaller height than the respective beam (2), and two positioning elements (4) for very two beams (2) that can be secured to a profile (3) such that each positioning element (4) extends substantially between the positioning ends (6) of two beams (2) stacked one on top of the other and the upper one of these beams (2) stacked one on top of the other is supported on this positioning element (4).

19 Claims, 6 Drawing Sheets

(56) References Cited

U.S. PATENT DOCUMENTS

| | | | | | |
|---|---|---|---|---|---|
| 2,414,060 | A | * | 1/1947 | Rausch | 403/219 |
| 2,453,221 | A | * | 11/1948 | Haden | 52/461 |
| 2,930,222 | A | * | 3/1960 | Bender | 52/286 |
| 3,026,977 | A | * | 3/1962 | Pollock et al. | 52/481.2 |
| 3,178,775 | A | * | 4/1965 | Tassell | 52/474 |
| 3,251,169 | A | * | 5/1966 | Cornelissen | 52/779 |
| 3,371,454 | A | * | 3/1968 | Anderson | 52/126.4 |
| 3,490,800 | A | * | 1/1970 | Wissler | 52/586.2 |
| 3,566,561 | A | * | 3/1971 | Tozer | 52/127.12 |
| 3,600,867 | A | * | 8/1971 | Shuey | 52/284 |
| 3,849,960 | A | * | 11/1974 | Henry et al. | 52/569 |
| 4,391,077 | A | * | 7/1983 | Giess | 52/748.11 |
| 4,503,647 | A | * | 3/1985 | Post | 52/233 |
| 4,599,837 | A | * | 7/1986 | Wrightman | 52/233 |
| 4,742,657 | A | * | 5/1988 | Veech | 52/233 |
| 4,867,598 | A | * | 9/1989 | Winter, IV | 403/381 |
| 5,244,300 | A | * | 9/1993 | Perreira et al. | 403/381 |
| 5,361,556 | A | * | 11/1994 | Menchetti | 52/561 |
| 5,577,356 | A | | 11/1996 | Hubbard et al. | |
| 5,609,435 | A | * | 3/1997 | Nomura | 403/387 |
| 5,682,719 | A | * | 11/1997 | Huang | 52/775 |
| 5,799,452 | A | * | 9/1998 | Moore | 52/233 |
| 5,864,997 | A | * | 2/1999 | Kelly | 52/282.2 |
| 5,890,332 | A | * | 4/1999 | Skidmore et al. | 52/271 |
| 5,918,999 | A | * | 7/1999 | Lamarca | 403/397 |
| 5,921,046 | A | * | 7/1999 | Hammond, Jr. | 52/564 |
| 5,960,599 | A | * | 10/1999 | Schmidt et al. | 52/282.2 |
| 6,059,631 | A | * | 5/2000 | Maddock | 446/127 |
| 6,094,876 | A | * | 8/2000 | Ogo et al. | 52/233 |
| 6,128,876 | A | * | 10/2000 | Nitschke et al. | 52/239 |
| 6,185,887 | B1 | * | 2/2001 | Strassle | 52/282.2 |
| 6,189,282 | B1 | * | 2/2001 | VanderWerf | 52/582.1 |
| 6,272,802 | B1 | * | 8/2001 | Berberich | 52/233 |
| 6,493,995 | B2 | * | 12/2002 | McKenzie | 52/36.4 |
| 6,568,143 | B2 | * | 5/2003 | Coleman | 52/604 |
| 6,837,016 | B2 | * | 1/2005 | Simmons et al. | 52/655.1 |
| 6,874,291 | B1 | * | 4/2005 | Weber | 52/586.1 |
| 6,931,803 | B1 | * | 8/2005 | Davis et al. | 52/251 |
| 7,313,890 | B2 | * | 1/2008 | Clarke | 52/233 |
| 7,340,868 | B2 | * | 3/2008 | Weber | 52/586.1 |
| 7,806,038 | B2 | * | 10/2010 | Duke | 89/36.04 |
| 7,841,141 | B2 | * | 11/2010 | Nordli | 52/233 |
| 7,845,266 | B2 | * | 12/2010 | Duke et al. | 89/36.04 |
| 8,209,917 | B1 | * | 7/2012 | DeZaio | 52/79.5 |
| 8,365,483 | B2 | * | 2/2013 | Hijazi | 52/245 |
| 8,371,080 | B2 | * | 2/2013 | Wrightman | 52/233 |
| 8,567,139 | B2 | * | 10/2013 | Stein | 52/233 |
| 8,572,928 | B2 | * | 11/2013 | Bruder | 52/775 |
| 8,615,963 | B2 | * | 12/2013 | Wrightman | 52/741.13 |
| 8,671,640 | B1 | * | 3/2014 | Thomas | 52/586.2 |
| 8,701,364 | B2 | * | 4/2014 | Wrightman | 52/233 |
| 2001/0054268 | A1 | * | 12/2001 | Coleman | 52/604 |
| 2002/0046422 | A1 | * | 4/2002 | Perett | 4/524 |
| 2003/0019170 | A1 | * | 1/2003 | Donnelly | 52/144 |
| 2004/0118056 | A1 | * | 6/2004 | Peters et al. | 52/79.1 |
| 2004/0163358 | A1 | * | 8/2004 | Clarke | 52/782.1 |
| 2004/0177575 | A1 | * | 9/2004 | Posselt | 52/282.1 |
| 2004/0255531 | A1 | * | 12/2004 | Middleton | 52/233 |
| 2005/0034413 | A1 | * | 2/2005 | Weber | 52/720.1 |
| 2006/0179768 | A1 | * | 8/2006 | Lindeen et al. | 52/582.1 |
| 2006/0288654 | A1 | * | 12/2006 | Clarke | 52/233 |
| 2007/0006539 | A1 | * | 1/2007 | Gurstein | 52/233 |
| 2007/0006542 | A1 | * | 1/2007 | Duke | 52/561 |
| 2007/0175129 | A1 | * | 8/2007 | Nordli | 52/233 |
| 2007/0199273 | A1 | * | 8/2007 | Wang | 52/604 |
| 2007/0245638 | A1 | * | 10/2007 | Lai | 52/79.1 |
| 2007/0294967 | A1 | * | 12/2007 | Posselt | 52/233 |
| 2008/0127583 | A1 | * | 6/2008 | Wrightman et al. | 52/233 |
| 2008/0134599 | A1 | * | 6/2008 | Downing | 52/233 |
| 2008/0263988 | A1 | * | 10/2008 | Moerenhout et al. | 52/590.2 |
| 2009/0056251 | A1 | * | 3/2009 | Wrightman | 52/233 |
| 2009/0133345 | A1 | * | 5/2009 | Wrightman | 52/233 |
| 2009/0199497 | A1 | * | 8/2009 | Wrightman | 52/233 |
| 2010/0011694 | A1 | * | 1/2010 | Spaans et al. | 52/586.1 |
| 2010/0043323 | A1 | * | 2/2010 | Wrightman | 52/233 |
| 2010/0180527 | A1 | * | 7/2010 | Kim | 52/309.13 |
| 2010/0282060 | A1 | * | 11/2010 | Duke et al. | 89/36.02 |
| 2011/0107718 | A1 | * | 5/2011 | Middleton | 52/745.16 |
| 2011/0209436 | A1 | * | 9/2011 | Fabbri | 52/762 |
| 2012/0198781 | A1 | * | 8/2012 | Wrightman | 52/233 |

FOREIGN PATENT DOCUMENTS

| | | | | |
|---|---|---|---|---|
| DE | 20318781 | U1 | | 4/2004 |
| EP | 2453061 | A1 | * | 5/2012 |
| EP | 2453076 | A1 | * | 5/2012 |
| FR | 2556022 | A1 | * | 6/1985 |
| FR | 2907478 | A1 | | 4/2008 |
| GB | 2485412 | A | * | 5/2012 |
| WO | 99/23322 | A1 | | 5/1999 |

OTHER PUBLICATIONS

International Preliminary Report on Patentability for PCT/IB2011/002979 issued Jun. 18, 2013 (5 pages).*

* cited by examiner

FIG. 3
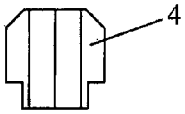
FIG. 4
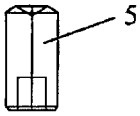
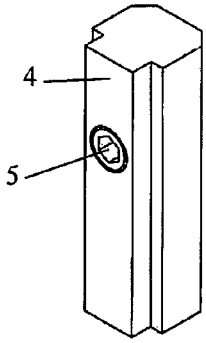
FIG. 5
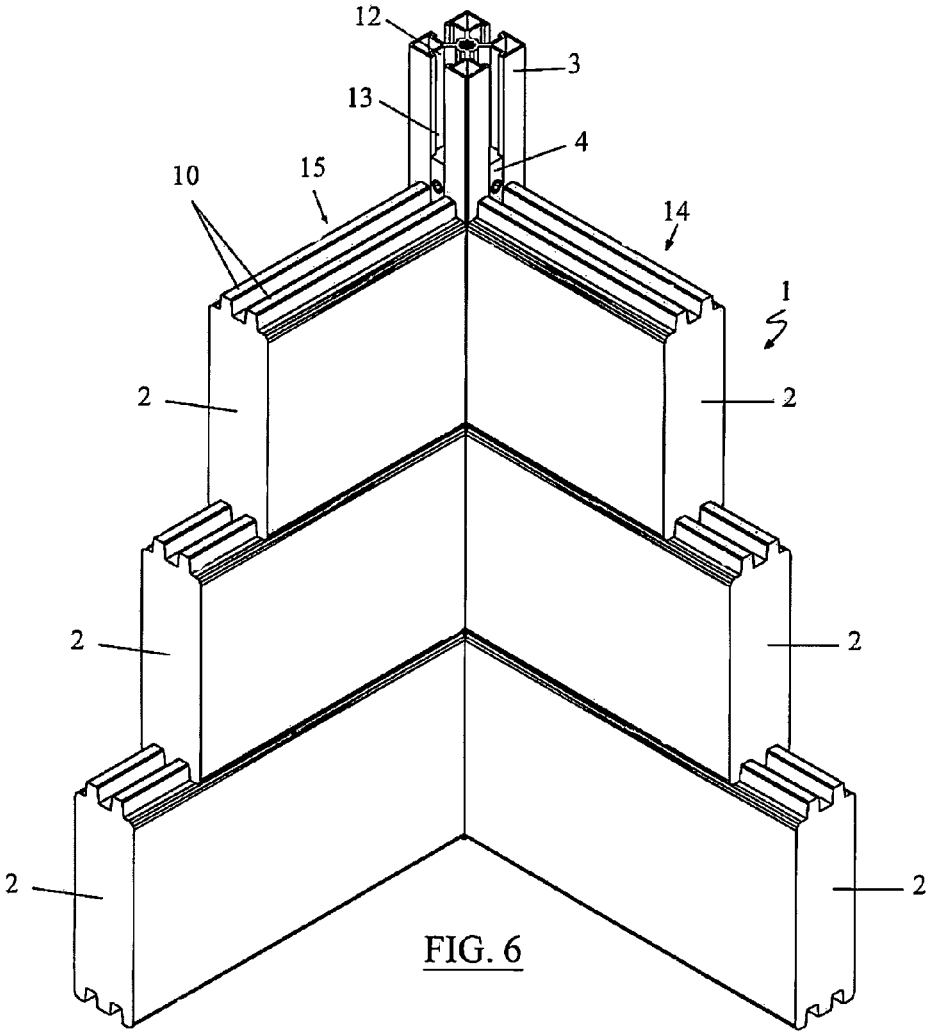
FIG. 6

FIG. 9
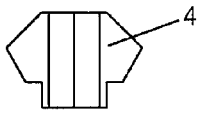
FIG. 10
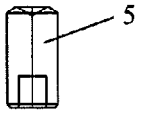
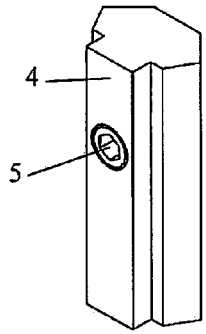
FIG. 11
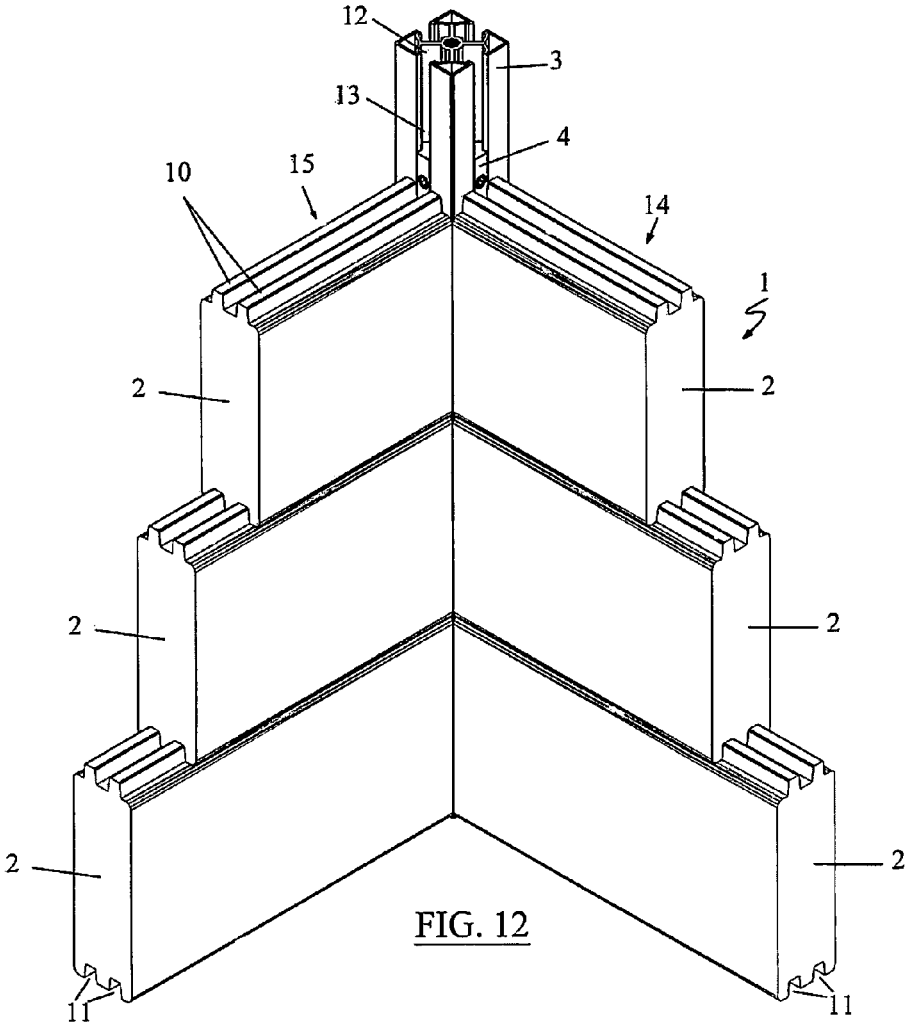
FIG. 12

WALL ASSEMBLY FOR WOODEN STRUCTURES

This application claims the benefit of Belgian patent application No. 2010/0744, filed Dec. 16, 2010, which is hereby incorporated by reference in its entirety.

This invention concerns a wall assembly for the construction of a wall element, comprising:

at least two profiles, which in the mounted state of the wall element extend substantially vertically as ends of the wall element;

at least two beams, which in the mounted state of the wall element are stacked one on top of the other and extend substantially horizontally between the two mentioned profiles;

and a positioning element that can be secured to a profile such that this positioning element in the mounted state of the wall element is located between the two beams stacked one on top of the other and the upper one of these beams stacked one on top of the other is supported on this positioning element.

Such wall assemblies most often are part of structures that are constructed from massive timber construction. Such massive timber construction is a building method in which wooden beams are stacked on each other to produce a structure such as a building. These structures can be, for example, chalets, saunas, weekend houses, houses, summer houses, swimming pools, fences, caravans, and so on.

By profile is meant an elongated element having substantially the same cross section over its length.

A known problem with massive timber construction is that by expansion and shrinkage of the beams a wall assembly of approximately 2 meters (6.6 ft.) height can sink by as much as 3 cm (1.2 in) over the course of time, due to the cumulative height shrinkage of the beams stacked on each other. In the case of a sauna, where greater temperature fluctuations occur and the relative humidity fluctuates greatly, a sauna cabin can even sink by as much as 5 cm (2 in) along its height.

A major drawback here is that doors and windows can become heavily loaded by beams that are stacked on them and no longer supported by underlying beams. These doors and windows can become warped or can no longer be opened or closed under this load. A further drawback is that it is not expected of the working of a building etc. that a wall assembly can settle by as much as 3 cm (1.2 in).

Where a roof or a mezzanine is not supported by the walls that are constructed from stacked beams, cracks are also produced, making the structure leaky. In the case of saunas, heat escapes through these cracks, so that great energy losses result.

A number of partial solutions to these problems have already been found.

For sauna and chalet structures, one often tries to fix the beams at their initial height by securing them with the help of screws or pegs, for example, to profiles that extend vertically along either side of the stacked beams as the ends of a wall element. However, in the course of time shrinkage of the beams often causes cracks to appear between these beams, that are now no longer supported by each other, but only supported by these screws and pegs. A major disadvantage of fixing the beams at their initial height in this way is that an extra space is in each case required at the ends of a wall element and next to this wall element in order to be able to secure these beams with these screws or pegs. In order to be able to mount a sauna with a base of 2 m (6.6 ft.) by 1.5 m (4.9 ft.), one needs an installation surface of 4 m (13 ft) by 3.5 m (11.5 ft.) in this way, taking into account the fact that one needs a space of approximately 1 m (3.3 ft.) width around the sauna in order to be able to fix the beams at their initial height with screws or pegs. After the assembly is complete, one then still has to succeed to move the assembled structure to the desired position.

One solution for which no such assembly space is required is to stack the beams on each other across rafters, after which the beams are pulled against each other by means of a tension rafter, so that they are already placed under tension from the start. In practice, however, these beams need to be able to be tensioned to a greater or lesser extent afterwards. Such structures can be used, for example, for swimming pools, but are least suited for saunas or chalets where doors and windows are provided. This solution cannot remedy the mentioned problems resulting from expansion and shrinkage of the beams.

To further remedy these problems in past, one will provide the tension rafters with built-in clamping spring systems as described in DE 38 04 525 A1 and in DE 20 2006 008 U1, with the springs having to ensure a tightening of the beams in case of shrinkage and a relaxation in case of swelling.

As an alternative to remedy the problem of installation space, one can prefabricate massive panels, as described for example in DE 197 39 787 A1. With such a solution, however, everyone needs to keep the temperature and humidity under control during the process. Yet problems resulting from expansion or shrinkage can occur whenever sufficient attention is not paid to the temperature and humidity of the surroundings during transport, storage or delivery.

In DE 198 41 359 C1, a solution is described whereby, according to the preamble of the first claim, the beams themselves are not fixed at their initial height with screws or pegs, but instead fixed wooden rails are placed between the beams and between the profiles, each being fixed at a particular height to these profiles with screws. However, wall elements need to be mounted in advance in order to avoid having to have a space of around 1 m (3.3 ft.) width around a sauna in order to be able to place these elastic positioning elements between the beams with this solution. But because the beams are provided with a groove on two sides, this solution is not suitable for outdoor structures. For precipitation will get into the grooves at the top of the beams and considerably shorten the lifetime of the structure.

The purpose of this invention is to provide a connection system whereby the aforementioned problem is remedied. The purpose is therefore substantially to provide a solution that neutralizes the natural dimensional variations due to shrinkage and/or expansion in such a wall assembly.

This purpose of the invention is achieved by providing a wall assembly for the construction of a wall element comprising:

at least two profiles, which in the mounted state of the wall element extend substantially vertically from the wall element as ends of the wall element;

at least two beams, which in the mounted state of the wall element are stacked one on top of the other and extend substantially horizontally between the two mentioned profiles;

a positioning element that can be secured to a profile such that this positioning element in the mounted state of the wall element is located between the two beams stacked one on top of the other and the upper one of these beams stacked one on top of the other is supported on this positioning element;

wherein the beams at each end comprise a positioning end that has a height which is smaller than the height of the respective beam and wherein the wall assembly for two beams that are provided to be stacked one on top of the other in the mounted state of the wall element comprises two such positioning elements, which are designed to extend, in the mounted state of the wall element, each at a respective end of the beams, substantially between the positioning ends of the two beams stacked one on top of the other.

Thanks to the positioning elements, the height differences for every beam are prevented from accumulating in the event of expansion or shrinkage of the beams, so that large height differences for every wall element no longer occur. The beams can indeed shrink or expand in themselves, without departing from their initially assigned positioning.

Positioning elements that do not extend over the complete length between the profiles, but only extend substantially between positioning ends of the beams, can be secured to the profile from its side against which the beams extend in the mounted state of the wall element, so that extra installation space in the prolongation of the wall element is no longer required to be able to mount this wall element.

Each positioning element is therefore preferably configured so as to be able to be fastened to a profile from the side of the profile against which the beams extend in the mounted state of the wall element.

Preferably, the positioning elements in the mounted state of the wall element extend only between the respective positioning ends of the two beams stacked one on top of the other, so that the beams can adjoin each other as tightly as possible when stacked on each other. When the beams have coinciding dimensions, the height of these positioning elements is then preferably smaller than or equal to the net construction height of a beam, minus the height of its positioning end.

The positioning elements of such a wall assembly are preferably rigid.

In order to be able to assemble a wall element firmly without needing additional fastening means, besides the fastening means that may be used to be able to secure the positioning elements to the profiles, each profile in a preferred embodiment of a wall assembly according to this invention is provided with a slot, in which the respective positioning ends of the beams can be at least partly disposed and in which the positioning elements can be at least partly disposed.

Preferably, then, each profile is provided at least at one end with an entry opening to the aforesaid slot, by which the positioning ends and the positioning elements can be at least partly arranged in this slot. In this way, when mounting a wall element, one can first place the profiles in their correct position, after which one can alternatingly arrange the positioning ends of the beams and the corresponding positioning elements in the slots of the profiles one by one, so as to arrange the beams between these profiles. Also when arranging the positioning elements these are preferably secured to the corresponding profile at the theoretical building height.

Again to achieve a firm structure, the cross section of the positioning ends is preferably complementary to the cross section of the slot.

By complementary is meant that the cross section of the positioning ends and the cross section of the slot are matched to each other, so that the cross section of the positioning ends is somewhat smaller than the cross section of the slot and can be fully taken up in it.

In order to be able to provide maximum support to the positioning ends and thereby also be able to provide maximum support to the beams, the cross section of the positioning elements is preferably complementary to the cross section of the slot.

By complementary is meant that the cross section of the positioning elements and the cross section of the slot are matched to each other, so that the cross section of the positioning elements is somewhat smaller than the cross section of the slot and can be fully taken up in it.

In one specific embodiment of a wall assembly according to this invention, each profile is provided with flanges that partly bound the aforesaid slot, so that they delimit a through opening to this slot.

Each positioning end is then preferably configured at least in part broader than the width of the through opening, in which case the profile then comprises an aforesaid entry opening so that this positioning end cannot be moved in and out of the slot through this through opening, but only via the aforementioned entry opening.

To realize an especially firm fixation of the positioning elements to such a profile, each positioning element in such a specific embodiment is preferably configured so that it can be secured to an aforementioned profile by clamping it against these flanges.

Each positioning end in such a specific embodiment is then preferably provided with a narrowing that has a width that is smaller than or equal to the width of the aforesaid through opening.

In one particular embodiment of a wall assembly according to this invention, at least one profile comprises a second slot, for attachment of two or more beams that are part of a second wall element.

The second slot in yet another particular embodiment is located at an angle with respect to the first-mentioned slot, so that the second wall element in the mounted state of the wall assembly extends at an angle with respect to the first-mentioned wall element.

Of course, the profiles can then be provided with several slots for attachment of several wall elements to the same profile, which can be located at different angles with respect to each other, corresponding to the angles of the slots with respect to each other.

The beams of a wall assembly according to this invention are preferably made of wood. Moreover, these beams are preferably each provided with at least one tongue and at least one groove, so that these beams can be stacked on each other by means of a tongue and groove connection.

The height of these tongues and grooves is preferably chosen such that after shrinkage of the beams there still remains a sufficient overlap of the tongues and grooves so that no cracks occur between the beams.

The profiles of a wall assembly according to this invention are preferably made of metal. More specifically, these profiles can be aluminium profiles, for example, that are made by means of extrusion. For aluminium has a negligible shrinkage and expansion, and suitable surface smoothness, rigidity and strength for the application. Furthermore, no rusting occurs with aluminium, it is user-friendly and fully recyclable.

The positioning elements of a wall assembly according to this invention are preferably made of polypropylene. These could also be made from another plastic, such as PVC, or of aluminium, etc.

The purpose of this invention is likewise achieved by providing a wall element that is constructed from a wall assembly according to the invention as described above. Such wall elements can be incorporated in structures such as summer houses, swimming pools, saunas, fences, houses, caravans, etc.

The purpose of this invention is furthermore also more specifically achieved by providing a sauna cabin that comprises a wall assembly according to this invention as described above.

This invention will now be explained more closely by means of the following detailed description of some preferred wall assemblies according to this invention. The purpose of this description is solely to give illustrative examples and point out further advantages and features of these wall assemblies, and thus can in no way be interpreted as a limitation of the area of application of the invention or the patent rights asserted in the claims.

In this detailed description, reference numbers make reference to the enclosed drawings, where FIG. 1 shows one end of a wall element constructed with a first embodiment of a wall assembly according to this invention in top view;

FIG. 3 shows a positioning element of the first embodiment of a wall assembly according to this invention in top view;

FIG. 4 shows a socket set screw in elevation view as the fastening element for fastening the positioning element from FIG. 3 in a slot of a profile of the first embodiment of a wall assembly according to this invention;

FIG. 5 shows the positioning element from FIG. 3 in perspective view, where the socket set screw from FIG. 4 is placed in a borehole of this positioning element;

FIG. 6 shows one end of a first and second wall element of the first embodiment of a wall assembly according to this invention, joining each other at an angle in perspective view;

FIG. 9 shows a positioning element from the second embodiment of a wall assembly according to this invention in top view;

FIG. 10 shows a socket set screw in elevation view as the fastening element for fastening the positioning element from FIG. 9 in a slot of a profile of the second embodiment of a wall assembly according to this invention;

FIG. 11 shows the positioning element from FIG. 9 in perspective view, where the socket set screw from FIG. 10 is placed in a borehole of this positioning element;

FIG. 12 shows one end of a first and second wall element of the second embodiment of a wall assembly according to this invention, joining each other at an angle, in perspective view;

A wall assembly (1) according to this invention is intended for the building of wall elements (14, 15) that can be incorporated in all kinds of structures made of massive timber construction. These structures can be, for example, summer houses, swimming pools, saunas, fences, houses, caravans, etc.

Figure 1:
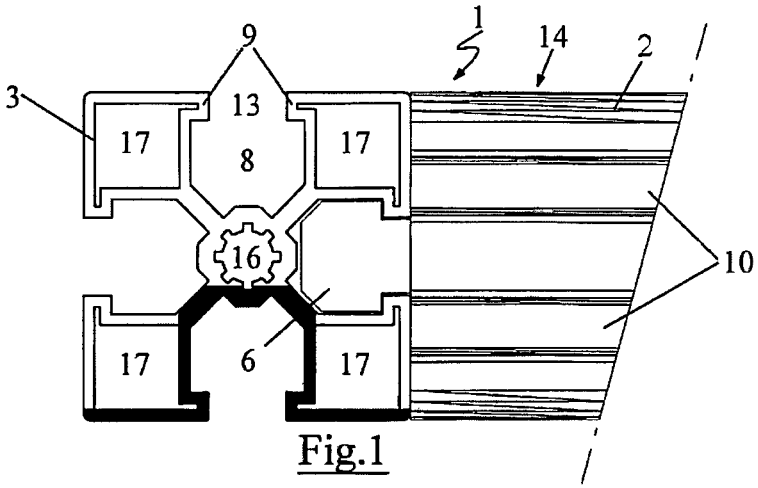
Figure 7:
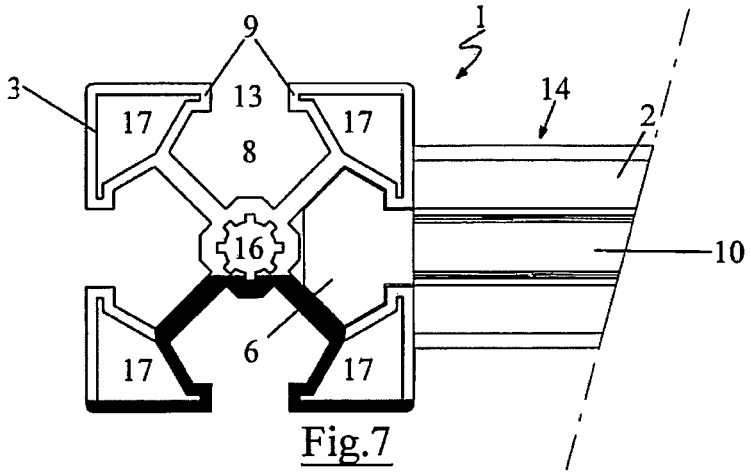
FIG. 7 shows one end of a wall element constructed with a second embodiment of a wall assembly according to this invention in top view.

Such a wall assembly (1), as depicted in the figures, always comprises at least two profiles (3) which in the mounted state of the wall element (14) extend substantially vertically as ends of the wall element (14). In FIGS. 1 and 7, part of such a wall element (14) is shown in top view at the height of one of these profiles (3). In FIGS. 6, 12, 13 and 14, one end of a first and a second wall element (14, 15) are shown in perspective view, which join each other at an angle with a joint angle profile (3).

The profiles (3) depicted are extruded metal profiles. Such extruded aluminium profiles that are currently available on the market are only suited to connection with other metal elements. The slots are narrower and less deep. In order to be able to make use of them as extruded profiles (3) for a wall assembly (1) according to the invention with wooden beams (2), the slots (8) need to be deep and broad enough. Depending on the application, these profiles (3) could also be manufactured from plastic, for example. It is also possible to make profiles for a wall assembly according to this invention from wood, for example, in which case one needs to take account of the material strength and the risk of splitting of this wood for a particular tensile strength and when using fastening elements to attach elements to these profiles (3).

In the mounted state of the wall element (14), several beams (2) that are stacked on each other extend substantially horizontally between these profiles (3). These beams (2) can be made from massive timber with the known techniques. For alternative applications, these could also be made, for example, from composite material or laminated wood, or plastic etc.

Figure 2:
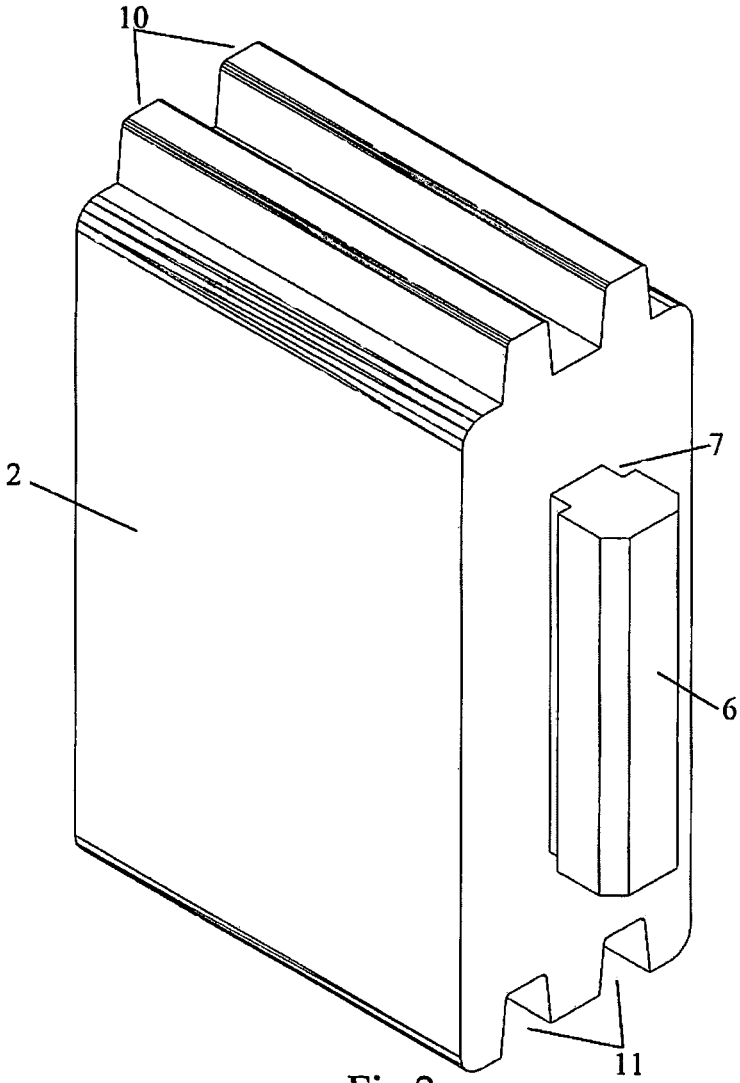
FIG. 2 shows one end of a beam from the first embodiment of a wall assembly according to this invention in perspective view.
Figure 8:
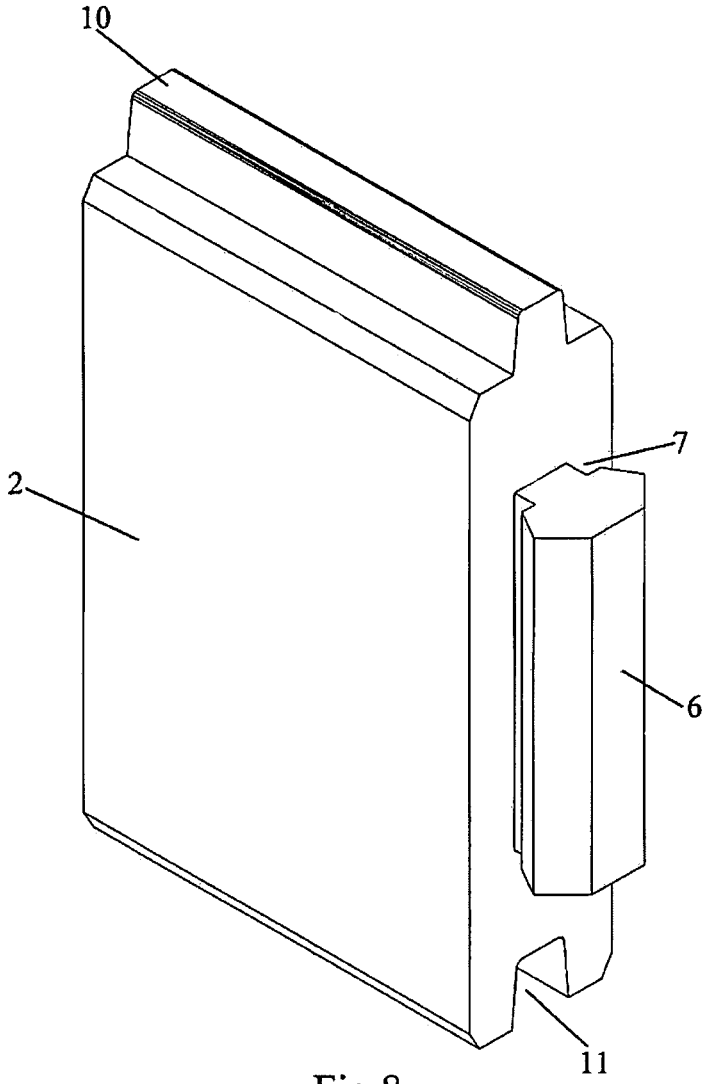
FIG. 8 shows one end of a beam from the second embodiment of a wall assembly according to this invention in perspective view.
Figure 13:
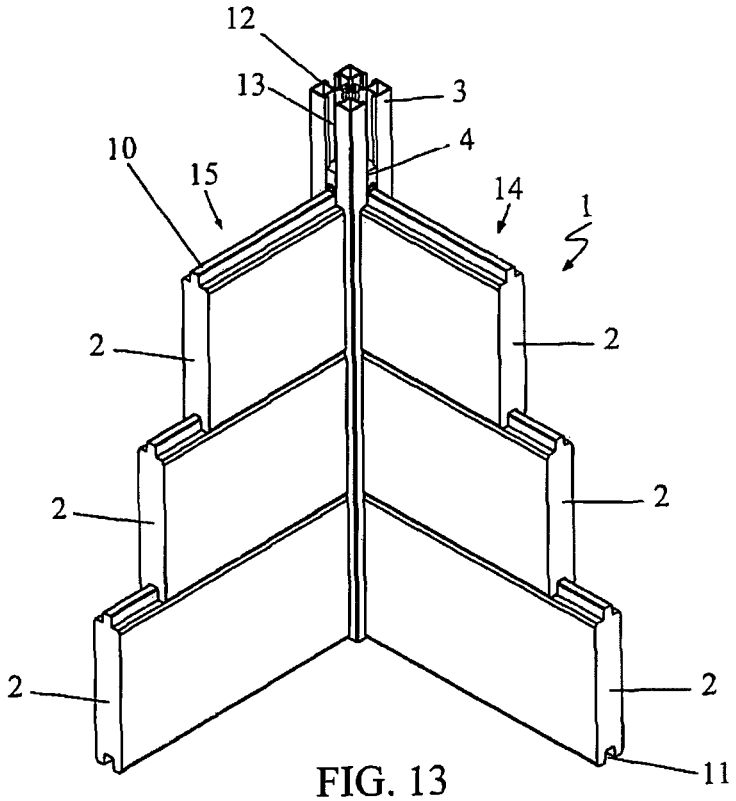
FIG. 13 shows one end of a first and second wall element of a third embodiment of a wall assembly according to this invention, joining each other at an angle, in perspective view.
Figure 14:
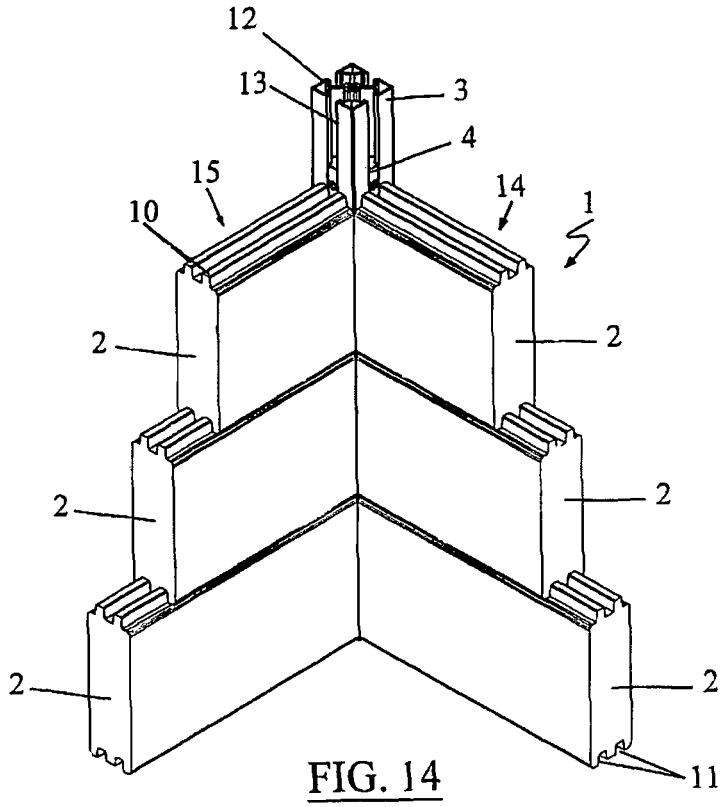
FIG. 14 shows one end of a first and second wall element of a fourth embodiment of a wall assembly according to this invention, joining each other at an angle, in perspective view.

In FIGS. 2 and 8, one end of such a beam (2) is shown separately in perspective view. The beams (2) comprise at each end a positioning end (6). This positioning end (6) has a height less than the height of the respective beam (2). The width of this positioning end (6) is also narrower than the width of the beam (2). Such a positioning end (6) can therefore be fabricated by four-sided crosscut milling of the corresponding end of the corresponding beam (2).

The beams (2) of the first embodiment of a wall assembly (1) as depicted in FIG. 2 are provided on their top side with two tongues (10) and on their bottom side with two grooves (11). The beams (2) of the second embodiment of a wall assembly (1) as depicted in FIG. 8 are provided on their top side with one tongue (10) and on their bottom side with one groove (11). Thanks to these tongues (10) and grooves (11), these beams (2) can be stacked on each other with the help of a tongue and groove connection. The number of tongues (10) and the number of grooves (11) is preferably chosen as a function of the desired tongue and groove connection and as a function of the thickness of the beams (2). The height of the tongues (10) and grooves (11) is chosen such that when the height of the beams (2) in the wall element (14, 15) is fixed according to this invention, even upon shrinkage of the beams (2) an overlap will always remain between the tongues (10) and the grooves (11), so that no cracks occur between the beams (2).

The beams (2) of the depicted embodiments are moreover symmetrical in construction, so that when these beams are mounted in a wall assembly (1) one can choose which flat side to turn inward or outward.

Besides the profiles (3) and the beams (2), a wall assembly (1) according to this invention also comprises two positioning elements (4) for every two beams (2) to be stacked on one another. Such positioning elements (4) are also shown separately in FIGS. 3, 5, 9 and 11. These positioning elements (4) can be fastened to the profiles (3), each at a respective end of the beams (2), so that these positioning elements (4) in the mounted state of the wall element (14) are located between the positioning ends (6) of these two stacked beams (2) and the upper one of these stacked beams (2) is supported on these positioning elements (4) by its positioning ends (6).

The depicted positioning elements (4) are made of polypropylene. However, it is also possible to make such positioning elements (4) from another plastic, or from metal etc. The material used is preferably sufficiently firm so that, after fastening of these positioning elements (4) to the profiles (3), the respective beams (2) can be supported by means of these positioning elements (4).

As is clearly shown in FIGS. 3, 5, 9 and 11, the positioning elements (4) are provided with a borehole for fastening of a socket set screw (5), which is shown separately in FIGS. 4 and 10. With the help of such a socket set screw (5), such a positioning element (4) can then be fastened to a profile (3).

The depicted profiles (3) each comprise four slots (8), in which the positioning elements (4) and the positioning ends (6) of the beams (2) can be arranged. For this, the profiles (3) are provided on their top side with entry openings (12) to these slots (8), by which the positioning elements (4) and the positioning ends (6) can be arranged in the slots (8). Each profile (3), moreover, is provided with flanges (9) that partly border on the slots (8), so that they delimit at least partly a through opening (13) to this slot (8).

As can clearly be seen in FIGS. 6 and 12-14, the positioning elements (4) in such embodiments can be arranged so that they are removed from view in the mounted state of the wall assembly (1). These positioning elements (4) furthermore fill up the opening between positioning ends (6) of stacked beams (2) as much as possible, so that the connection becomes water and wind-tight and energy losses are limited.

The cross sections of both the positioning elements (4) and the positioning ends (6) of the beams (2) in the various depicted embodiments of wall assemblies (1) are each time fashioned to be as complementary as possible to the cross section of the corresponding slots (8), to enable a maximum supporting of the beams (2). As is clearly shown in FIGS. 2 and 8, the positioning ends (6) are provided with a narrowing (7). This narrowing (7) has a width that is less than or equal to the width of the through opening (13), so that the beams (2) can be arranged in the slots (8) with the help of these positioning ends (6). The width of that part of the positioning ends (6) that can be arranged in the slots (8) themselves is broader than the width of the through opening (13).

The slots (8) in the second embodiment are designed so that a wall assembly (1) according to this second embodiment can handle greater lateral tensile forces than a wall assembly (1) with the slots (8) from the first embodiment.

When building a wall element (14, 15) with these depicted wall assemblies (1), one first arranges a positioning element (4) in the desired slots (8) of the profiles (3) in which beams (2) are to be arranged. After this, a beam (2) is arranged between two profiles (3) by arranging it with the help of its positioning ends (6) in the slots (8) of these profiles (3) via the entry openings (12). Then on top of each positioning end (6) a positioning element (4) is placed in the corresponding slot (8) via the corresponding positioning opening (12). These positioning elements (4) are fixed at the desired height by tightening the socket set screws (5) until the positioning elements (4) are drawn tight against the flanges (9). As is clearly shown in FIGS. 6, 12, 13 and 14, the socket set screws (5) can be reached for this purpose from the side of the profile (3) against which the beams (2) extend, so that no surrounding space is needed in the prolongation of the wall elements (14, 15) in order to mount them. In the depicted embodiments the socket set screws (5) are tightened against the core of fee respective profile (3) in order to tighten the positioning elements (4) against the flanges (9). After fixing the positioning elements (4) at the desired height, a second beam (2) is placed between the profiles (3). This second beam (2) is stacked on the first beam (2) so that it is supported by the positioning elements (4) that were fixed at the desired height on top of this first beam (2). After this, positioning elements (4) are again fixed on top of the positioning ends (6) of this second beam (2) at the desired height in the slots (8) against the flanges (9) in order to support a third beam (2) that will be stacked on the second beam (2). Then, in succession, positioning elements (4) and beams (2) are put in place until the complete wall element (14, 15) has been raised.

The beams (2) of the depicted wall assemblies (1) each time have coinciding dimensions. The positioning elements (4) in this case have a height that coincides with the net construction height of a beam (2), minus the height of its positioning end (6), so that all elements of the wall assembly (1) can initially join to each other in order to produce a firm unit that remains a firm unit even upon shrinkage and/or expansion of the beams (2).

The profiles (3) depicted in FIGS. 1, 6, 7 and 12-14 each time have four slots (8) in which beams (2) can be arranged at perpendicular angles to each other, in order to construct wall elements (14, 15) that extend at right angles to each other. However, wall assemblies (1) according to this invention can equally well comprise profiles (3) with more or fewer slots (8), where the angle at which different slots (8) are placed relative to each other in the profiles (3) can also differ from a right angle.

In FIGS. 15 to 18, a number of additional possible profiles (3) are depicted. It is of course possible to think of countless variants of the embodiments depicted. Already with the wall assemblies (1) depicted, a great diversity of structures can be built. A further diversity in structures can be achieved by using or not using the slots (8) provided. Thus, for example, one can provide unused slots (8), in order to be able to use these later on to build an addition. The positioning and the number of slots (8) is preferably chosen as a function of the desired construction that needs to be built with such a wall assembly (1).

Figure 15:
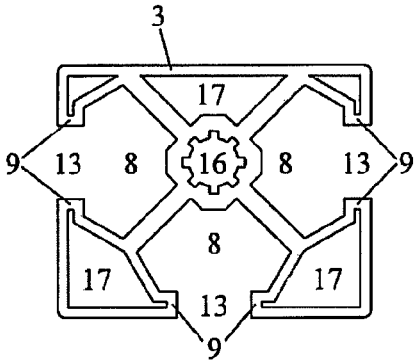
FIG. 15 shows a profile of a fifth embodiment of a wall assembly according to this invention in top view.

In the profile (3) of the embodiment depicted in FIG. 15, three slots (8) are provided at right angles to each other, so that beams (2) which are fastened to them can join each other in a T-shape.

Figure 16:
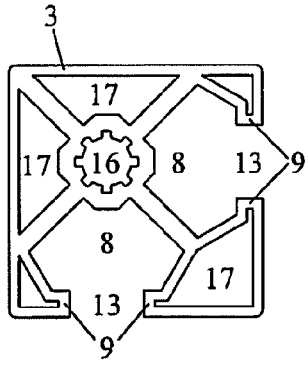
FIG. 16 shows a profile of a sixth embodiment of a wall assembly according to this invention in top view.

In the profile (3) of the embodiment depicted in FIG. 16, two slots (8) are provided at a right angle to each other, so that beams (2) that are fastened to them can join each other at a right angle.

Figure 17:
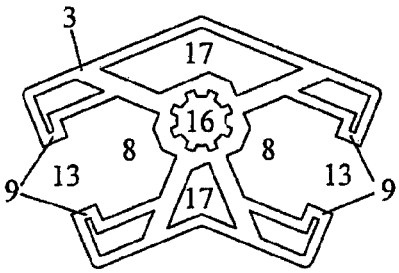
FIG. 17 shows a profile of a seventh embodiment of a wall assembly according to this invention in top view.

In the profile (3) of the embodiment depicted in FIG. 17, two slots (8) are provided at an angle of 135° relative to each other, so that beams (2) which are fastened to them can join each other at such an angle. In this way, it is also possible to realize octagonal structures, for example. Similarly, a profile (3) can be configured with slots (8) that are provided at an angle of 120° relative to each other, so that hexagonal structures can be realized with them.

Figure 18:
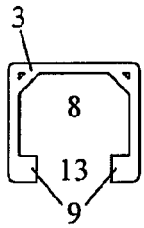
FIG. 18 shows a profile of an eighth embodiment of a wall assembly according to this invention in top view.

In the profile (3) of the embodiment depicted in FIG. 18, one slot (8) is provided. Between such profiles (3) one can make a connection with doors and/or windows, for example.

In most profiles (3) depicted, a through recess (16) is provided at the centre, with small raised edges at the margin. In this, one can secure feet for the profiles (3) with an M8 screw thread, for example, which can be adjustable in height, or adjoining profiles (3) can be attached, and so on, as is already known for such profiles in metal structures.

Moreover, the additional cavities (17) that are present in these profiles (3) can be used to take up wiring, for example, as is also already known for such profiles in metal structures.

The invention claimed is:

1. Wall assembly for construction of a wall element, comprising:

at least two profiles, which in a mounted state of the wall element extend substantially vertically as ends of the wall element;

at least two beams, which in the mounted state of the wall element are stacked one on top of the other and extend substantially horizontally between the two mentioned profiles;

a positioning element secured to at least one of the two profiles such that the positioning element in the mounted state of the wall element is located between the two beams stacked one on top of the other and an upper one of the two beams stacked one on top of the other is supported on the positioning element;

wherein the two beams at each end comprise a positioning end that has a height which is smaller than a height of the respective beam; and wherein the wall assembly for the two beams that are stacked one on top of the other in the mounted state of the wall element comprises two such positioning elements, which extend, in the mounted state of the wall element, each at the respective end of the two beams, only between the positioning ends of the two beams stacked one on top of the other.

2. Wall assembly according to claim 1, characterized in that the beams are made of wood.

3. Wall assembly according to claim 1, characterized in that the positioning elements are made of polypropylene.

4. Wall assembly according to claim 1, characterized in that the positioning elements are rigid.

5. Wall assembly according to claim 1, characterized in that the profiles are made of metal.

6. Wall assembly according to claim 1, characterized in that each positioning element is fastened to the at least one of the two profiles from a side of the at least one of the two profiles against which the beams extend in the mounted state of the wall element.

7. Wall assembly according to claim 1, characterized in that the beams are each provided with at least one tongue and at least one groove, so that these beams can be stacked on each other by means of a tongue and groove connection.

8. Wall assembly according to claim 1, characterized in that each profile is provided with a slot, in which the respective positioning ends of the beams can be at least partly disposed and in which the positioning elements can be at least partly disposed.

9. Wall assembly according to claim 8, characterized in that each profile is provided at least at one end with an entry opening to the aforesaid slot, by which the positioning ends and the positioning elements can be at least partly arranged in this slot.

10. Wall assembly according to claim 8, characterized in that the cross section of the positioning ends is complementary to the cross section of the slot.

11. Wall assembly according to claim 8, characterized in that the cross section of the positioning elements is complementary to the cross section of the slot.

12. Wall assembly according to claim 8, characterized in that each profile is provided with flanges that partly bound the aforesaid slot, so that the flanges delimit at least partly a through opening to this slot.

13. Wall assembly according to claim 12, characterized in that each positioning end is configured at least in part broader than the width of the through opening.

14. Wall assembly according to claim 13, characterized in that each positioning element is secured to the at least one of the two profiles by clamping against the flanges.

15. Wall assembly according to claim 13, characterized in that each positioning end is provided with a narrowing that has a width that is smaller than or equal to the width of the aforesaid through opening.

16. Wall assembly according to claim 8, characterized in that at least one profile comprises a second slot, for attachment of two or more beams that are part of a second wall element.

17. Wall assembly according to claim 16, characterized in that the second slot is located at an angle with respect to the first-mentioned slot, so that the second wall element in the mounted state of the wall assembly extends at an angle with respect to the first-mentioned wall element.

18. Wall element, comprising the wall assembly according to claim 1, wherein the wall element is in the mounted state.

19. Sauna cabin, characterized in that the sauna cabin comprises the wall assembly according to claim 1.

* * * * *